US006321708B1

(12) United States Patent
Wehner et al.

(10) Patent No.: US 6,321,708 B1
(45) Date of Patent: Nov. 27, 2001

(54) INLET MANIFOLD

(75) Inventors: Frank Wehner, Steisslingen (DE); Jakob Widrig, Winterthur (CH); Wolfgang Sterzl, Radolfzell; Klaus Löschmann, Braunschweig, both of (DE)

(73) Assignees: Alusuisse Technology & Management Ltd., Neuhausen (CH); Volkswagen AG, Wolfsburg (DE)

( * ) Notice: Subject to any disclaimer, the term of this patent is extended or adjusted under 35 U.S.C. 154(b) by 0 days.

(21) Appl. No.: 09/414,619

(22) Filed: Oct. 8, 1999

(30) Foreign Application Priority Data

Oct. 8, 1998 (CH) ..... 2035/98

(51) Int. Cl.[7] ..... F02M 35/10
(52) U.S. Cl. ..... 123/184.61; 123/184.57
(58) Field of Search ..... 123/184.61, 184.57, 123/184.53, 184.21, 184.24, 184.39, 184.42, 184.46, 184.47

(56) References Cited

U.S. PATENT DOCUMENTS 4,301,775 * 11/1981 Smart et al. ..... 123/184.61
4,805,564 * 2/1989 Hudson, Jr. ..... 123/184.42
5,704,325 * 1/1998 Sattler et al. ..... 123/184.42
6,021,753 * 2/2000 Chaffin et al. ..... 123/184.61

FOREIGN PATENT DOCUMENTS 195 04 256 8/1996 (DE) .

* cited by examiner

*Primary Examiner*—Noah P. Kamen
*Assistant Examiner*—Hai Huynh
(74) *Attorney, Agent, or Firm*—Cohen, Pontani, Lieberman & Pavane

(57) ABSTRACT

Inlet manifolds such as intake manifolds, collector tanks, intake pipes, oscillatory intake passages, systems with variable-tract intake manifolds etc., for internal combustion engines operating on the principle of the diesel or Otto engine, where the inlet manifold includes two or more dish-shaped parts that are permanently joined to each other, and the dish-shaped parts are formed sheet parts, castings and/or extruded sections of metal. The permanent joining of the dish-shaped parts may be effected e.g. by adhesive bonding and/or welding.

15 Claims, 5 Drawing Sheets

10
22
12
16
24
19
18
26

TURBO-CHARGER, COMPRESSOR, CARBURATOR, OR INJECTOR
14
13
21
29
15
25
23
19
11
27

INLET MANIFOLD

BACKGROUND OF THE INVENTION

1. Field of the Invention

The present invention relates to an inlet manifold for internal combustion engines functioning on the principle of Otto-engine or diesel-engine.

2. Discussion of the Prior Art

It is known that internal combustion engines feature, on the intake side, inlet manifolds for transportation and distribution of air and fuel mixtures. Depending on the arrangement of the component and the preparation of the fuel-air mixture, the inlet manifolds may be intake manifolds, collector tanks, intake passages, intake pipes, collector intake pipes, collectors and individual intake runners, oscillatory intake passages, intake runners, resonance chambers and resonance intake pipes, variable-configuration intake manifolds and systems with variable-tract intake manifolds etc.

Known inlet manifolds such as the intake channel of a variable-configuration intake manifold according to DE-A 195 04 256 are made of polyamides. Generally known are also inlet manifolds of cast metal. In general, inlet manifolds are made by sand casting metal or are made of plastic, in each case using the lost-wax core principle. These parts and the methods of manufacture exhibit disadvantages. Sand casting results in components with widely varying wall thickness e.g. with thickness limits of 2.5 to 4.5 mm. Consequently, castings are heavy and the surfaces are rough. Rough inner surfaces impair the flow behaviour of the fluids passing through the component, rough outer surfaces are detrimental to the appearance and haptic of the part. Also, residual amounts of the shape-forming core may remain in the component, and the component may have to be worked further by chipforming processes. Some of these disadvantages may be overcome by using plastics. However, because of the ever increasing thermal load on engine components it is necessary to employ suitably heat-resistant plastics. These heat-resistant plastics are expensive and e.g. polyamides which are particularly suitable are difficult to recycle.

SUMMARY OF THE INVENTION

The object of the present invention is to provide an inlet manifold which can be manufactured simply and in a cost-favourable manner, is light, exhibits a smooth inner surface and is easy to recycle.

That objective is achieved by way of an inlet manifold according to the invention which is made up of two or more dish-shaped parts which are permanently joined together, and the dish-shaped parts are shaped sheet parts, castings and/or extruded sections of metal.

The inlet manifold may advantageously be made up of two dish-shaped parts. It is also possible to manufacture e.g. more complex inlet manifolds from two or more dish-shaped parts e.g. from three, four, five or six dish-shaped parts.

A weld seam or adhesively bonded seam may be provided between the individual dish-shaped parts at the points of contact between them. The dish-shaped parts may exhibit shoulders with shoulder areas that run around the whole of the outer edge of the parts in question. On fitting the dish-shaped parts together to form an inlet manifold the dish-shaped parts touch at the shoulders. The shoulders may be omitted at openings such as e.g. the intake and outlet openings or recesses for devices for regulating and measuring purposes.

The shoulder regions may be joined by weld seams or adhesively bonded seams in order to provide a permanent joint there. One of the dish-shaped parts may also feature a grooved section running round the edge or a recess in the shoulder, while the other dish-shaped part features a peripheral connecting projection or rib. On fitting the dish-shaped parts together, the rib engages in the grooved section or fits onto the shoulder recess. The connecting rib and the grooved section or the recess in the shoulder may form a weld joint region. Accordingly, a weld seam may be created at that place in question. Joining with adhesive to make an adhesive connection join is likewise possible. The connecting rib and the grooved section or shoulder recess may be designed as a self-locking clip joint.

The dish-shaped parts are of metal. Suitable metals are aluminium and its alloys or magnesium and its alloys. Examples thereof are alloys of the AlSi, AlSiMg or AlSiCu type. Preferred are alloys of the AlSi and AlSiCu type.

The dish-shaped parts are made e.g. by pressing or stamping or by stamping and pressing sheet material. Complicated shapes—in particular the inner contours of dish-shaped parts can also be made by laying pre-shaped parts in the press-forming die. Other manufacturing processes for making the dish-shaped parts are deformation processes employing high internal pressure, with or without the influence of heat, superplastic forming, deep drawing, stretch drawing, impact extrusion etc. The sheets may be of the same or different thickness or exhibit a stepwise difference in thickness viz., so called tailored blanks. Further, the dish-shaped parts may be manufactured by casting. For example, they may be made by pressure diecasting or by casting blanks with thixotropic properties. The methods used lead to the desired smooth surfaces on the stamped, press-formed or cast shaped parts. Subsequent chip-forming treatment of the part can generally be omitted.

The prepared dish-shaped parts are then permanently joined to each other. For that purpose, the two or more dish-shaped parts are assembled to form an inlet manifold. For example one dish-shaped part forms a lower dish and a second dish-shaped part forms an upper dish. In another version the inlet manifold may exhibit a lower dish made of one single part or two such parts and an upper dish of one or two parts. Both the upper and the lower dish may exhibit shoulders with shoulder areas at the edge of the dish. In some cases the shoulders are interrupted by openings that are necessary for technical reasons e.g. openings for intake or outlet of gases, and openings to allow parts of measuring and control devices to be inserted. The shoulder areas making contact with each other are joined together by means of a weld seam or adhesively bonded seam. Instead of, or in addition to the welding or adhesive bonding, the parts may be joined by clipping them together, by riveting, screwing, clamping or flanging them together. In the latter cases a seal or sealing mass is usefully provided along the shoulder areas. Further possibilities for joining these shoulder regions together is to employ a combination of adhesive bonding and welding e.g. spot weld-bonding, or a combination of adhesive bonding and riveting and penetration bonding such a rivet-bonding, or folding and adhesive bonding to form a folded seam that is also adhesively bonded.

The weld seam may be made by arc welding under inert gas such as TIG or MIG welding, using plasma welding, electron beam welding, laser welding such as ruby, YAG, neodinium or $CO_2$ laser welding, friction welding etc. The dish-shaped parts are preferably joined together by weld seams made by laser welding or friction.

The adhesively bonded seam may be created using an adhesive. Examples of adhesives are—apart from the physically bonding adhesives—the particularly suitable chemically bonding adhesives which include reaction-type adhesives such as the two-component adhesives with epoxy resins and acidic anhydrides, epoxy resins and polyamines, poly-isocyanates and polyols or single component adhesives cyanacrylates or methacrylates, two-component adhesives of unsaturated polyesters and styrene or methacrylates, single component adhesives of pheno-plastics and polyvinylacetates or nitril-caoutchoucs, two-component adhesives of pyro-mellite-acidic-anhydride and 4.4 diamino-diphenyl-ether forming polyimides, or of polybenzimide-azoles. Plastics that form duroplastic or elastic compounds are to be given preference.

The surfaces of the inlet manifold may be smooth, matt or embossed. It is also possible to provide functional or decorative shapes in the dish-shaped parts. Inlet manifolds may be given optically attractive shapes and/or created with writing, logos or patterns—this in addition to their functional shape. By providing the inlet manifolds with appropriate further functional shapes, they can at the same time serve as an engine cover, means of concealment, as decorative a element and/or as sound-proofing or noise reducing means. For example, instead of shoulders, the dish-shaped parts may exhibit much enlarged shoulder regions, which cover over the underlying engine parts. This cover can serve as a screen e.g. screening off spraying fluids such as water, as thermal shielding, as means of concealment, as a decorative cover, as a substrate for decorative embossed images and/or as a substrate for projecting elements, and/or to reduce noise. Parts projecting out of the intake manifold may also be held by one or more supports that may be part of the lower and/or upper dish-shaped parts. This way it is possible to accommodate large forces acting on the projecting parts. Projecting parts are e.g. the intakes for fresh air. In particular, stiffening or brackets may be provided on the lower and/or upper dish-shaped parts in order to reduce or eliminate acoustic vibrations which e.g. cause humming sounds. These means of stiffening or brackets are e.g. groove-shaped recesses, depressions or indents which are preferably created in the lower and/or upper dish-shaped part during their manufacture. The stiffening means are preferably situated in the region of essentially smooth-surfaced parts such as in the collector tank.

The inlet manifolds according to the present invention may be employed e.g. as intake manifolds, collector tanks, intake passages, intake pipes, collector intake pipes, collectors and individual intake runners, oscillatory intake passages, intake runners, resonance chambers and resonance intake pipes, variable-configuration intake manifolds and systems with variable-tract intake manifolds depending on the type of engine viz., naturally aspirated, turbo-charged or compressor type engines, engines with a carburettor, with single or multi-point injection, as a rule situated in the inlet tract, or engines with direct injection. The inlet manifolds here are suitable for engines operating on the principle of the diesel or Otto engine.

The weight of the inlet manifolds according to the invention is about 50% less than that of known inlet manifolds made of sand-cast aluminium. The production of pressed sheet parts and die castings is simple. The metals employed are highly valued secondary raw materials and the inlet manifolds can be readily recycled. The metals used exhibit a high strength at elevated temperatures. The inlet manifolds can be manufactured by stamping or press-forming or as cast dish-shaped parts without chip-forming after-treatments.

BRIEF DESCRIPTION OF THE DRAWING

FIG. 1 shows a perspective view of a lower dish and FIG. 2 a perspective view of an upper dish-shaped part of an inlet manifold according to the present invention. FIG. 3 shows in front elevation a view of the upper dish in FIG. 2 and FIG. 4 a plan view of the lower dish in FIG. 1. FIGS. 5 to 10 show variants of the lower and upper dish-shaped parts with further features added.

DETAILED DESCRIPTION OF THE PREFERRED EMBODIMENTS

Figure 1:
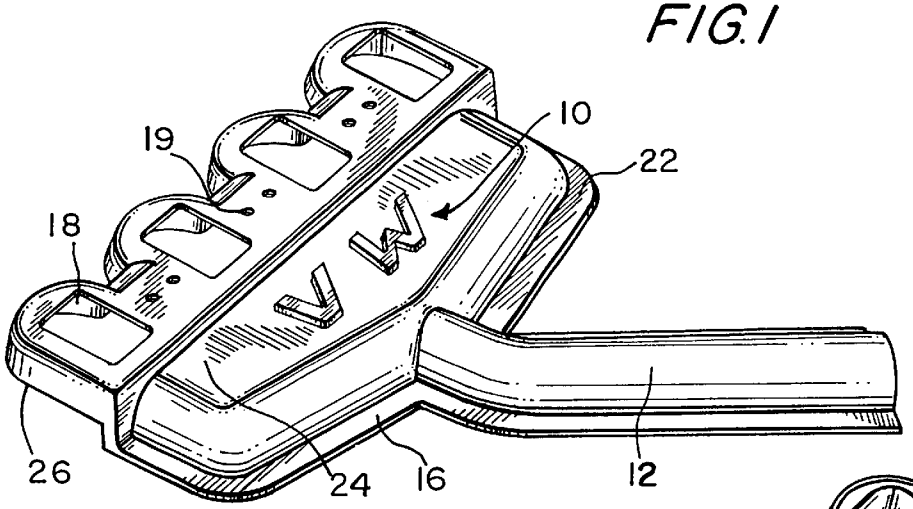
FIGS. 1 to 10 illustrate the present invention further by way of example.
Figure 2:
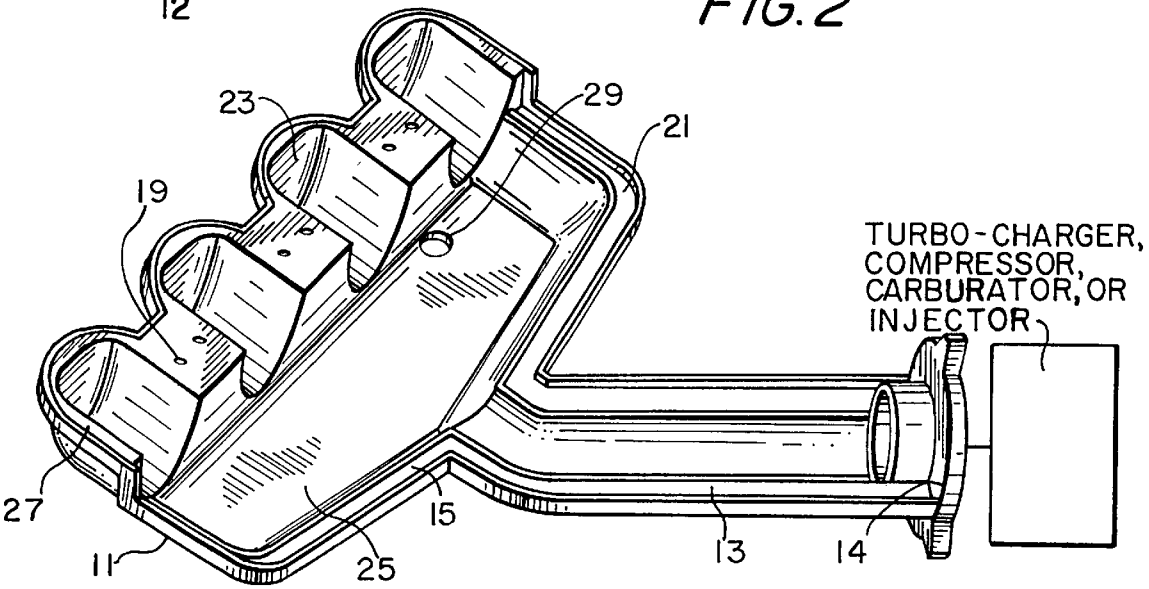

Shown in FIG. 1 is the lower dish 10 which, together with the upper dish 11 in FIG. 2, essentially forms the inlet manifold. The intake pipe comprising the halves 12 and 13 joins up with the collector tank comprising halves 24 and 25. The recesses 23 form the intake manifolds. Instead of the recesses 23 it is possible to provide pipe-shaped projections, as desired winding or winding and featuring a valve-type mechanism to extend or shorten the through-flow route. The sucked-in or blown-in air or fuel mixture leave the inlet manifold via the openings 18 which are flush with inlets in the combustion chambers in the engine block (not shown here). The openings 19 are holes through which e.g. screws pass securing the inlet manifold to the engine block. Surrounding the lower dish 10 is the peripheral shoulder 15, 21, 27. When mounted into place, the shoulders make contact with each other around the whole periphery region e.g. in region 15 and 16, or 21 and 22, or 26 and 27. Parts 10 and 11 are joined over the whole shoulder region, in particular gas-tight, advantageously by adhesive bonding or welding. A flange 14 is attached, pressed into, adhesively bonded or welded to the end of the intake pipe 12, 13. This flange is for joining up e.g. by screws, rivets etc. to the facilities for feeding gas or air or for preparing the gas mixture, to the air filter or measuring and control devices for preparation of the gas mixture etc. Opening 29 allows a measuring device to be introduced there.

FIG. 2 also schematically shows how the flange 14 is connectable to a turbo-charger, a compressor, a carburetor or an injector. FIG. 1 further shows an example of letters, logos or patterns which can be formed in the dish parts 10, 11.

Figure 3:
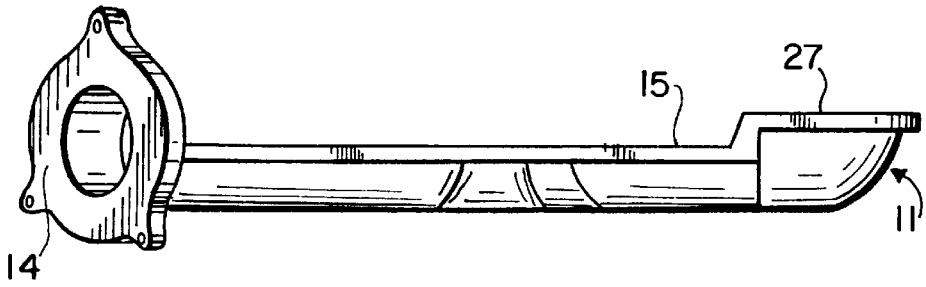
Figure 4:
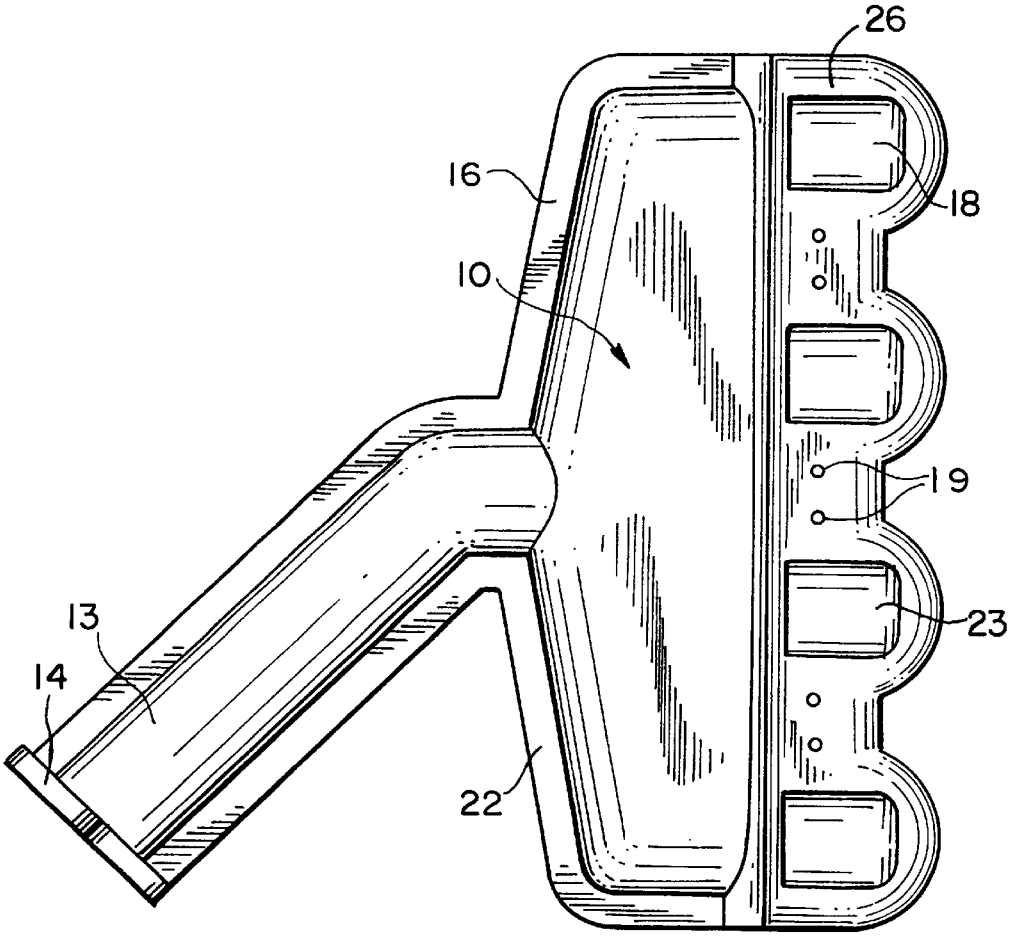

FIG. 3 shows in front elevation the upper dish 11. Flange 14 is attached to one end of the intake pipe. The shoulder areas 15 and 27 are in contact—in some cases via an adhesive—with the shoulder areas 16 and 26 resp. of the lower dish in FIG. 4. In FIG. 4 can be seen the intake pipe 13 and the recesses 23 with the openings 18 for passage of the gas or fuel mixture. The openings 19, in particular drilled holes 19, may accommodate attachment screws.

Figure 5:
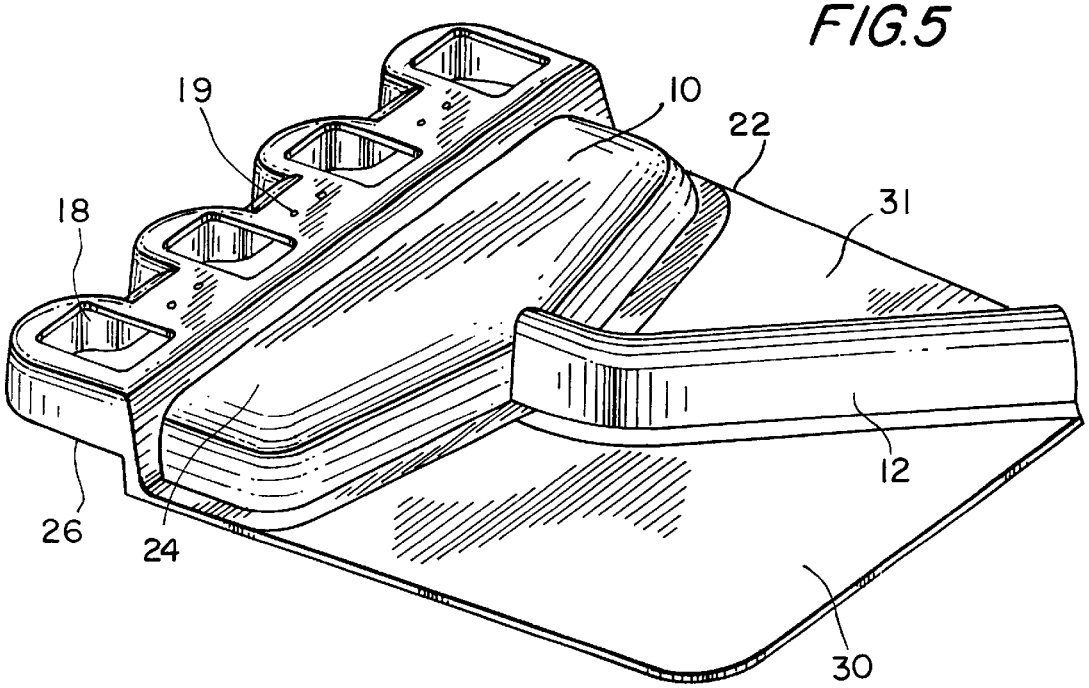
Figure 6:
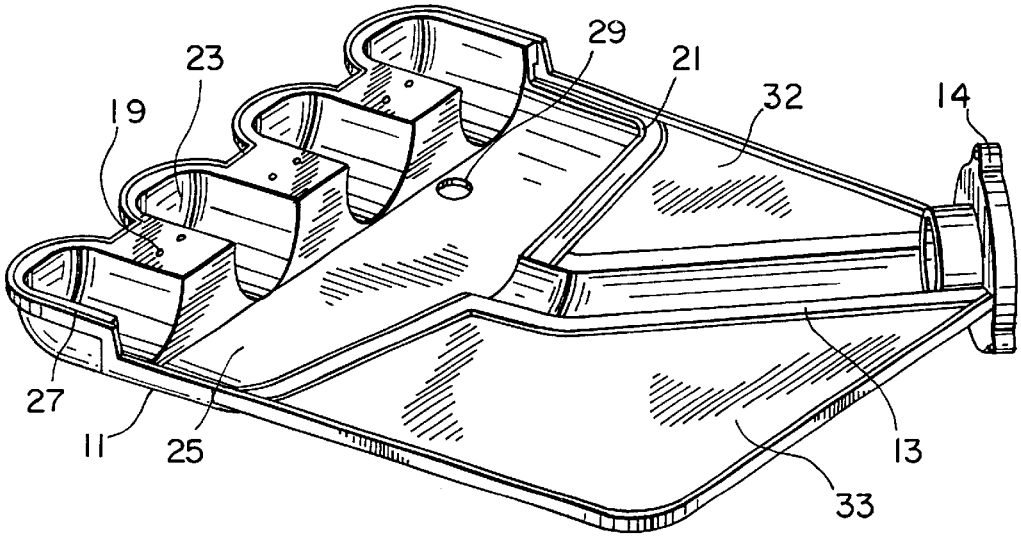

FIGS. 5 and 6 show a lower dish and an upper dish as in FIGS. 1 and 2. The meaning of the numbers can be taken from the description of FIGS. 1 and 2. The shoulders 15, 16, 21 and 22 in FIGS. 1 and 2 on the lower dish have been shaped into shoulder areas 30, 31 which can serve as a form of screening, likewise shoulder areas 32, 33 on the upper dish 11. The screening 30, 31 and 32, 33 extends e.g. over the whole range of the intake pipe 12, 13. The screening 32, 33 represents e.g. a means of concealing the mechanical parts underneath, and can feature decorative aspects. The screening 32, 33 may also contribute to dampening or reducing noise. The upper dish 11 and the lower dish 10 may be joined together permanently in the manner described above, it being possible for the screening means 30, 31 and 32, 33 to be joined together completely or over only part of the surface.

Figure 7:
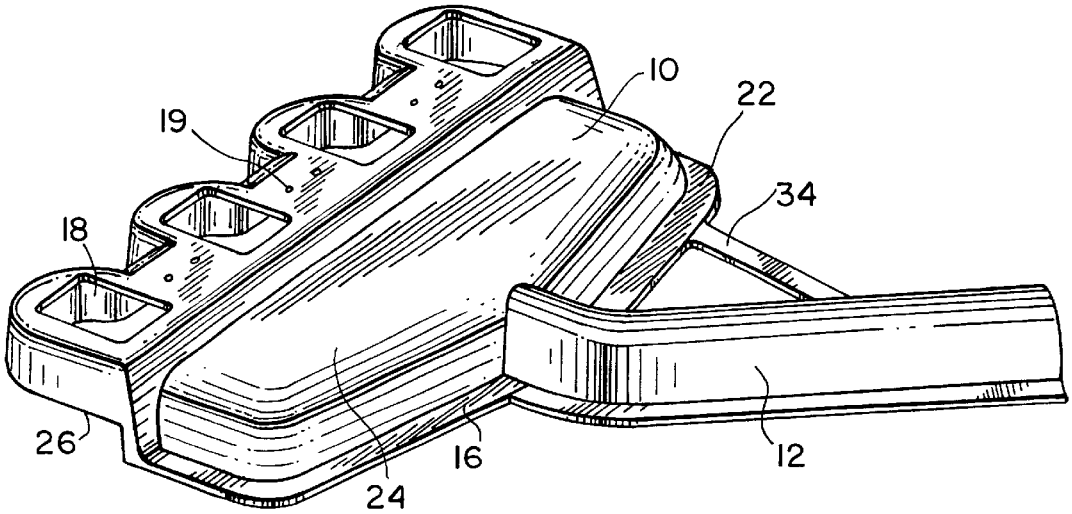
Figure 8:
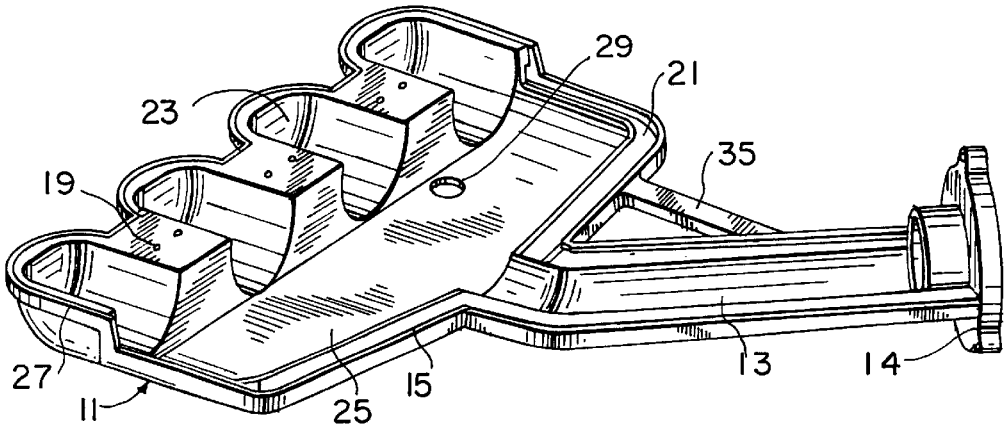

FIGS. 7 and 8 show a lower dish and an upper dish as in FIGS. 1 and 2. The meaning of the numbers can be taken from the description of FIGS. 1 and 2. In addition to the versions described above, the intake pipes 12, 13 are joined by a strut or support 34 on the lower dish 10 and by a strut or support 35 on the upper dish 11. This enables large forces acting on the intake pipe 12, 13 to be accommodated.

Figure 9:
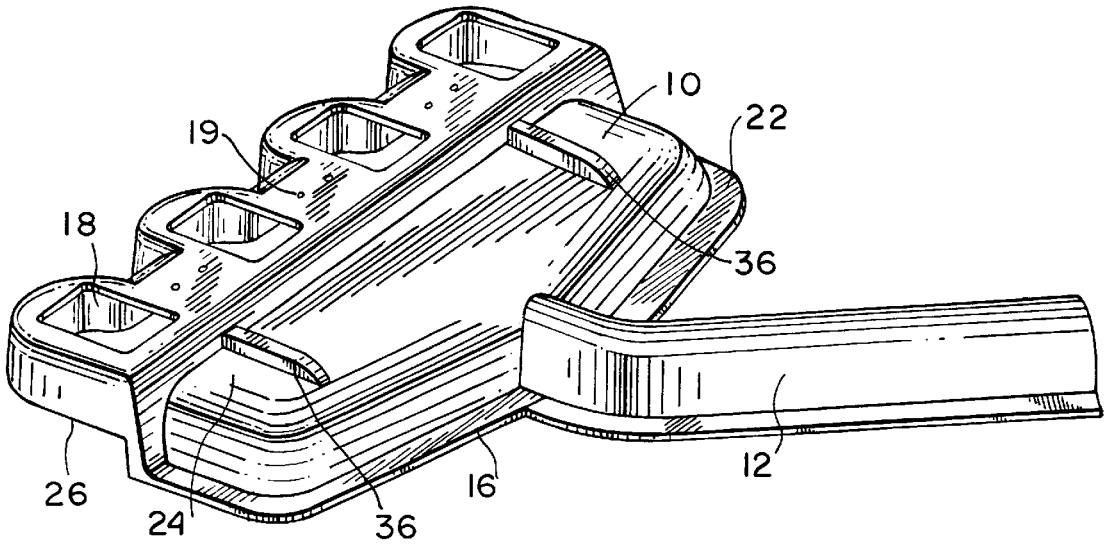
Figure 10:
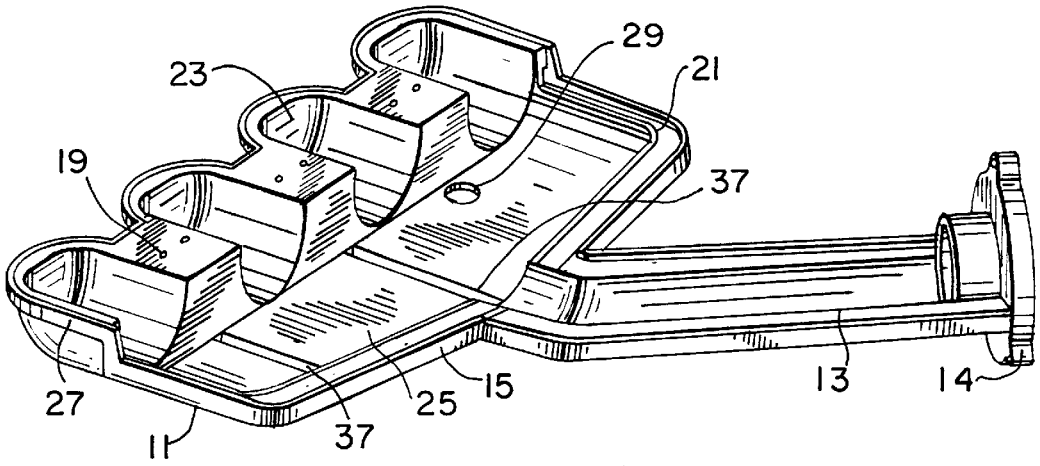

FIGS. 9 and 10 show a lower dish and an upper dish as in FIGS. 1 and 2. The meaning of the numbers can be taken from the description of FIGS. 1 and 2. Means of stiffening or struts 36 are shown by way of example on the lower dish 10. The stiffening means 36 may be created at the same time as the lower dish 10 itself is formed. The same holds for the stiffening means or struts 37 in the upper dish 11. The means of stiffening or struts 36, 37 are situated preferably in those areas where resonance vibration tends to occur e.g. in the present case at the large area region at the collector chamber 24, 25. Of course the stiffening 36, 37 with the struts 34, 35 or the screening 30, 31, 32, 33 may be used in combination.

What is claimed is:

1. An inlet manifold for an internal combustion engine functioning according to the principle of the Otto engine or the diesel engine, the manifold comprising at least two dish-shaped parts that are permanently joined together by at least one of a weld seam, and adhesively bonded seam, spot welding, rivet-adhesive bonding, and a folded seam with adhesive bonding, the dish-shaped parts being at least one of stamped sheet parts and extruded sections of one of aluminum, aluminum alloy, magnesium and magnesium alloy.

2. An inlet manifold according to claim 1, wherein the manifolds consists of two dish-shaped parts.

3. An inlet manifold according to claim 1, wherein the dish-shaped parts are joined together by one of a laser weld seam and a friction weld seam provided at places where the dish-shaped parts contact each other.

4. An inlet manifold according to claim 1, wherein the dish-shaped parts are joined together by an adhesively bonding seam provided at places where the dish-shaped parts contact each other, the bonding seam being a chemically bonding adhesive.

5. An inlet manifold according to claim 1, wherein the dish-shaped parts are functionally shaped.

6. An inlet manifold according to claim 1, wherein the dish-shaped parts are decoratively shaped.

7. An inlet manifold according to claim 1, wherein the dish-shaped parts are formed to have at least one of lettering, logos and patterns.

8. An inlet manifold according to claim 1, wherein the dish-shaped parts have shoulder regions where the dish-shaped parts are joined together.

9. An inlet manifold according to claim 8, wherein the shoulder regions include planar, screen-like areas.

10. An inlet manifold according to claim 8, and further comprising at least one strut arranged to project from the shoulder region of at least one of the two dish parts.

11. An inlet manifold according to claim 8, and further comprising means for stiffening the dish-shaped parts provided on at least one of the dish-shaped parts.

12. An inlet manifold according to claim 11, wherein the dish-shaped parts generally smooth-surfaced shapes, the stiffening means being provided at the smooth-surfaced shapes.

13. An inlet manifold according to claim 1, wherein the shaped sheet parts are made up of tailored blanks.

14. An inlet manifold according to claim 1, wherein the shaped sheet parts are made up of parts shaped by high pressure internal forming.

15. An inlet manifold according to claim 1, wherein the manifold is configured as one of an intake manifold, a collector tank, an intake passage, an intake pipe, a collector intake pipe, a collector and individual intake runner, an oscillatory intake passage, an intake runner, a resonance chamber and resonance intake pipes, a variable-configuration intake manifold and a system with variable-tract intake manifolds, on one of a naturally aspirated, a turbo-charged and a compressor type engine with one of a carburetor, with single or multi-point injection, and a direct injection operating on a diesel or Otto engine principle.

* * * * *